US007292200B2

(12) United States Patent
Posluszny et al.

(10) Patent No.: US 7,292,200 B2
(45) Date of Patent: Nov. 6, 2007

(54) PARASITICALLY COUPLED FOLDED DIPOLE MULTI-BAND ANTENNA

(75) Inventors: Jerry C. Posluszny, LaGrange Park, IL (US); Randy C. Posluszny, Lyons, IL (US)

(73) Assignee: Mobile Mark, Inc., Schiller Park, IL (US)

( * ) Notice: Subject to any disclaimer, the term of this patent is extended or adjusted under 35 U.S.C. 154(b) by 0 days.

(21) Appl. No.: 11/218,755

(22) Filed: Sep. 2, 2005

(65) Prior Publication Data

US 2006/0061515 A1 Mar. 23, 2006

Related U.S. Application Data

(60) Provisional application No. 60/612,321, filed on Sep. 23, 2004.

(51) Int. Cl.
*H01Q 9/26* (2006.01)

(52) U.S. Cl. ..... 343/803; 343/745; 343/700 MS

(58) Field of Classification Search ..... 343/795, 343/793, 702, 700 MS, 803
See application file for complete search history.

(56) References Cited

U.S. PATENT DOCUMENTS 3,229,298 A * 1/1966 Morgan ..... 343/806
3,689,929 A * 9/1972 Moody ..... 343/802
3,813,674 A * 5/1974 Sidford ..... 343/730
6,466,178 B1 * 10/2002 Muterspaugh ..... 343/795
6,791,500 B2 * 9/2004 Qi et al. ..... 343/702
2006/0220869 A1 * 10/2006 Kodukula et al. ..... 340/572.7

FOREIGN PATENT DOCUMENTS

JP 05-283926 * 10/1993

* cited by examiner

*Primary Examiner*—Hoanganh Le
(74) *Attorney, Agent, or Firm*—George H. Gerstman; Seyfarth Shaw LLP

(57) ABSTRACT

An antenna is provided which includes a primary folded dipole element and a feed for the primary folded dipole element. The primary folded dipole element is operable to resonate at a first frequency range. A parasitic dipole element is located within the primary folded dipole element and is spaced therefrom. The parasitic dipole element is operable to resonate at a frequency range that is higher than the first frequency range. Additional parasitic dipole elements may be located within the primary folded dipole element and spaced therefrom to resonate at different frequency ranges.

5 Claims, 1 Drawing Sheet

PARASITICALLY COUPLED FOLDED DIPOLE MULTI-BAND ANTENNA

Priority for this application is claimed based upon provisional application Ser. No. 60/612,321, filed Sep. 23, 2004, the disclosure of which provisional application is incorporated herein.

FIELD OF THE INVENTION

The present invention concerns a novel antenna, and, more particularly, a parasitically coupled folded dipole multi-band antenna.

BACKGROUND OF THE INVENTION

For many antenna applications it is desirable to have a single antenna that will function on two or more frequency bands. Many techniques exist which enable double or multiple resonances from a single antenna. They include multiple elements fed in parallel, single elements with wave traps which allow certain frequencies to use only a portion of the element, and parasitic coupled elements.

Parasitic elements typically have one driven element, for example a simple half wave length dipole antenna at the lowest frequency, and secondary elements which are resonant ½ wavelengths at different frequencies, positioned near the first element. Through inductive and/or capacitive coupling, the responses of the secondary elements can be seen at the first element's feed point. With proper adjustment of the lengths and the spacing of the element an effective multi-band antenna can be realized.

It is an object of the present invention to provide an efficient multi-band antenna, that is relatively simple in construction and easy to manufacture.

SUMMARY OF THE INVENTION

In accordance with the present invention, an antenna is provided which comprises a primary folded dipole element and a feed for the primary folded dipole element. The primary folded dipole element is operable to resonate at a first frequency range. A first parasitic dipole element is located within the primary folded dipole element and is spaced therefrom. The first parasitic dipole element is operable to resonate at a frequency range that is higher than the first frequency range.

In one embodiment, the first parasitic dipole element is a folded dipole element that is positioned in an offset relationship to the primary folded dipole element.

In one embodiment, a second parasitic dipole element is provided and is located within and spaced from the primary folded dipole element. The second parasitic element is operable to resonate at a frequency range higher than the frequency range of the first parasitic element.

In one embodiment, the primary folded dipole element and the first parasitic dipole element are formed on a printed circuit board.

In one embodiment, the primary folded dipole element is rectangular and includes dipole extensions which extend from the rectangle to provide a desired resonance.

In one embodiment, the primary folded dipole element and the first parasitic dipole element with the extensions are formed on a printed circuit board. The primary folded dipole element with the extensions and the first parasitic dipole element are formed of metal, with the metal extensions having a distal end with the metal extensions increasing in width toward that distal end to provide a wider bandwidth response.

A more detailed explanation of the invention is provided in the following description and claims, and is illustrated in the accompanying drawings.

DETAILED DESCRIPTION OF THE ILLUSTRATIVE EMBODIMENTS

Figure 1:
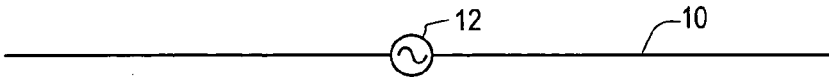
Fig. 1 Prior Art
FIG. 1 is an antenna having a single ½ wavelength dipole element shown in the prior art.
Figure 2:
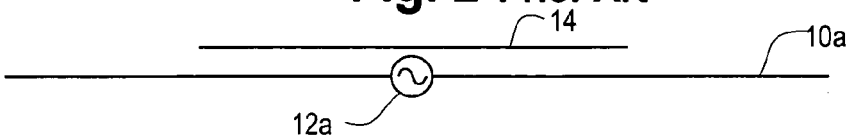
Fig. 2 Prior Art
FIG. 2 is an antenna having a single ½ wavelength dipole element with one parasitic element shown in the prior art.
Figure 3:
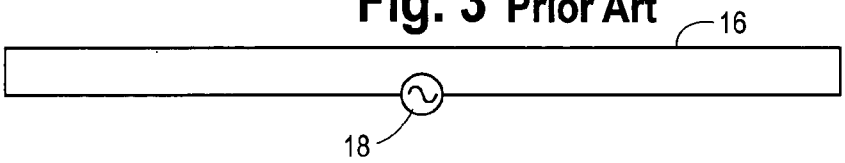
Fig. 3 Prior Art
FIG. 3 is an antenna having a single element ½ wavelength folded dipole shown in the prior art.

FIGS. 1-3 show prior art antennas. FIG. 1 is an antenna comprising a single ½ wavelength dipole element 10 with a center feed 12. FIG. 2 is a single ½ wavelength dipole element 10*a* with a center feed 12*a* and with a parasitic element 14. FIG. 3 is a single element ½ wavelength folded dipole 16 with a center feed 18.

Figure 4:
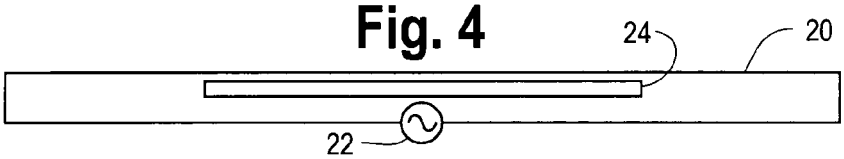
FIG. 4 is an antenna having a single element ½ wavelength folded dipole with one parasitically coupled folded dipole element, in accordance with one embodiment of the present invention.

Now referring to FIG. 4, an illustrative embodiment of the present invention is illustrated therein. FIG. 4 illustrates the present invention with a primary rectangularly-shaped folded dipole 20 having a center feed 22.

A folded dipole is similar to a standard single wire dipole but there is a second wire connected in parallel to the first wire. The configuration of a folded dipole looks like a wide flat loop with the feed in the center of the first wire. The length of the folded dipole is approximately ½ wavelength at the resonant frequency. The impedance of the folded dipole can be adjusted by varying the spacing of the parallel wires and the diameters of the wires. The folded dipole is used when the impedance of the antenna needs to be raised. In some instances it is desirable to use a partial folded dipole where the parallel wire section is shorter than the primary wire section; this gives more flexibility in impedance matching.

To obtain a second resonance with the folded dipole, a second folded element 24 is positioned inside the loop of the primary element. The second folded element is approximately ½ wavelength long at the desired second frequency. Like the primary element 20 the impedance of the second element can be adjusted by varying the width of the loop and the diameters of the wires. The second element is not attached to the feed point of the first element and is in effect a closed loop. A unique feature of the design is that a second folded dipole element 24 is parasitically coupled to the first folded element 22 by placing it in the actual loop of the first folded element 22. The impedance of the second element 24 can be varied by the actual placement in the primary element's loop. The second element 24 does not need to be a folded element but can be a single wire element or a loop. A third or more elements at different frequencies may be added into the primary element to allow more frequency responses to make a multi-frequency antenna.

Figure 5:
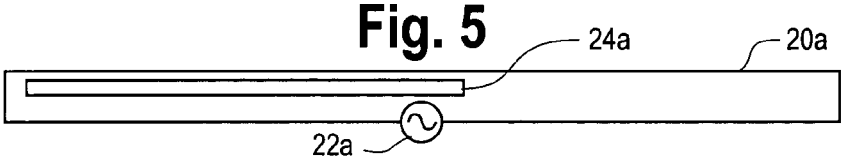
FIG. 5 is an antenna having a single element ½ wavelength folded dipole with one offset parasitically coupled folded dipole element, in accordance with another embodiment of the present invention.

FIG. 5 illustrates another embodiment of the invention in which there is a primary folded dipole 28*a* having a center feed 22*a*, with a parasitic dipole element 24*a* located within primary folded dipole element 20*a*. In FIG. 5 the parasitic element 24*a* is offset with respect to the center, as compared to element 24 of FIG. 4 which is centered. This allows selective impedance matching.

Figure 6:
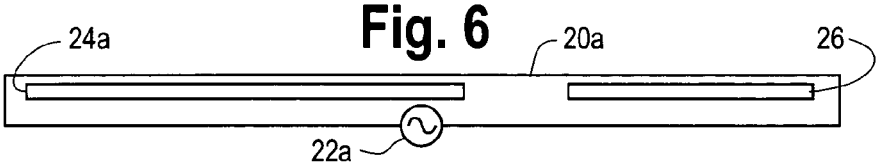
FIG. 6 is an antenna having a single element ½ wavelength folded dipole with two parasitically coupled folded dipole elements, in accordance with another embodiment of the present invention.

In FIG. 6, the primary folded dipole element 20*a* with center feed 22*a* has a first parasitic dipole element 24*a* similar to FIG. 5, but a second parasitic folded dipole element 26, which is offset from the center is also enclosed within primary folded dipole element 20*a*. This provides three resonant frequent bands. It is understood that additional parasitic dipole elements may be provided, for additional resonant frequency bands.

Figure 7:
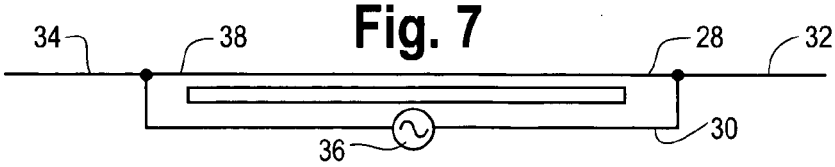
FIG. 7 is an antenna having a single element ½ wavelength partially folded dipole with one parasitically coupled folded dipole element, in accordance with another embodiment of the present invention.

Referring to FIG. 7, the primary folded dipole comprises an upper part 28, with bottom part 30 forming a rectangle having a center feed 36. A first dipole extension 32 is provided and a second dipole extension 34 is provided. Enclosed by the folded dipole 28, 30 there is a parasitic folded dipole element 38. Each of the primary folded dipole elements and each of the parasitic elements illustrated in FIGS. 4-7 are proximately ½ wavelength of the dipole's resonant frequency. Thus one skilled in the art may select the appropriate length and wire diameter to provide resonance at the desired resonant frequency. Although the elements are shown in rectangular form, under certain circumstances it may be desired to change the shape to oval, circular, or other configuration, with the particular length and diameter of the elements serving to define the resonant frequency band. Further, although the primary element is shown as center fed, the antenna feed may be other than central.

It has been found effective to print the metal antenna on an insulative printed circuit board. To this end, in FIG. 8 there is shown an insulative circuit board 31 having a copper antenna printed thereon. The antenna is similar to the antenna of FIG. 7, and includes a primary folded dipole element comprising a top portion 28, a first dipole extension 32, a second dipole extension 34 and bottom portion 30 which forms a rectangle with top portion 28. A center feed 36 is provided. In addition, an offset rectangular parasitic folded element 38 is enclosed within the primary folded dipole element 28, 30 and is spaced therefrom.

Figure 8:
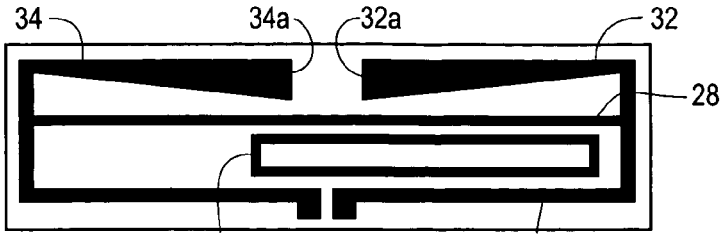
FIG. 8 is an antenna on a printed circuit board in accordance with the principles of the present invention.

As illustrated in FIG. 8, extensions 32 and 34 have distal ends 32*a* and 34*a* respectively, and extensions 32 and 34 increase in width toward the distal ends to provide a wider band width response. Printed circuit board 31 is 1/16 inch thick single-sided, with no finish on the copper whereby the copper is bare and shiny after edging. In the specific example illustrated in FIG. 8, although there is no limitation with respect to particular sizes, the etched antenna is 2 7/16" in width and 5/16" inch in height, with the printed circuit board being 3" inches in width and 7/8" in height. The resonant frequency of the primary element 28, 30 with extensions is 824 MHz to 894 MHz and the resonant frequencies of the parasitic element 38 is 1,850 MHz to 1990 MHz. Of course there is no limitation with respect to these element sizes and resonant frequencies and it has been found that a printed circuit board as illustrated in FIG. 8 is useful in the vehicle tracking industry for vehicle tracking. It can be located in a housing which is placed under the dashboard, under the rear bumper, or in other locations. For example, in Posluszny U.S. Pat. No. 6,873,297, a license plate frame with antenna is disclosed, and the antenna used in this license plate frame could be the antenna of the present invention, using printed circuit board 31.

Thus the antenna of the present is extremely useful in low profile antenna technology. The antennas may provide operation in various frequency bands, including but not limited to the cellular, PCS, and GPS bands.

Although illustrative embodiments of the invention have been shown and described, it is to be understood that various modifications and substitutions may be made without departing from the novel spirit and scope of the present invention.

What is claimed is:

1. An antenna which comprises:

a primary folded dipole element;

a feed for said primary folded dipole element;

said primary folded dipole element being operable to resonate at a first frequency range;

said primary folded dipole element being rectangular and including dipole extensions extending from said rectangle to provide a desired resonance;

a first parasitic dipole element;

said first parasitic dipole element being rectangular;

said first parasitic dipole element being located within said primary folded dipole element and spaced therefrom;

said first parasitic dipole element being operable to resonate at a frequency range higher than said first frequency range;

said primary folded dipole element including dipole extensions extending from said rectangle to provide a desired resonance;

said primary folded dipole element with said extensions and said first parasitic dipole element being formed of metal on a printed circuit board, said extensions having a distal end with said extensions increasing in width toward said distal end to provide a wider band width response.

2. An antenna which comprises:

a primary folded dipole element;

a feed for said primary folded dipole element;

said primary folded dipole element being operable to resonate at a first frequency range;

a first parasitic dipole element;

said first parasitic dipole element being located within said primary folded dipole element and spaced therefrom;

said first parasitic dipole element being operable to resonate at a frequency range higher than first frequency range;

said primary folded dipole being rectangular and including dipole extensions extending from said rectangle to provide a desired resonance;

said primary element with said extensions and said parasitic element being formed of metal on a printed circuit board, said extension having a distal end with said extensions increasing in width towards said distal end to provide a wider band width response.

3. An antenna which comprises:

a primary folded dipole element;

a feed for said primary folded dipole element;

said primary folded dipole element being operable to resonate at a first frequency range;

said primary folded dipole element being rectangular;

a first parasitic dipole element;

said first parasitic dipole element being located within said primary folded dipole element and spaced therefrom;

said first parasitic dipole element being operable to resonate at a frequency range higher than said first frequency range;

said primary folded dipole element and said first parasitic dipole element being formed on a printed circuit board;

said primary folded dipole element Including dipole extensions extending from said rectangle to provide a desired resonance, said primary folded dipole with said extensions and said parasitic dipole element being formed of metal on said printed circuit board;

said extensions having a distal end with said extensions increasing in width toward said distal end to provide a wider band width response.

4. An antenna which comprises:

a primary folded dipole element;

a feed for said primary folded dipole element;

said primary folded dipole element being operable to resonate at a first frequency range;

a first parasitic folded dipole element;

said first parasitic folded dipole element being located within said primary folded dipole element and spaced therefrom;

said first parasitic folded dipole element being operable to resonate at a frequency range higher than first frequency range;

said primary folded dipole being rectangular and including dipole extensions extending from said rectangle to provide a desired resonance; and said primary element with said extensions and said parasitic element being formed of metal on a printed circuit board and said extensions having a distal end with said extensions increasing in width toward said distal end to provide a wider bandwidth response.

5. An antenna which comprises:

a primary folded dipole element;

a feed for said primary folded dipole element;

said primary folded dipole element being operable to resonate at a first frequency range;

said primary folded dipole element being rectangular;

a first parasitic folded dipole element;

said first parasitic folded dipole element being located within said primary folded dipole element and spaced therefrom;

said first parasitic folded dipole element being operable to resonate at a frequency range higher than said first frequency range;

said primary folded dipole element including dipole extensions extending from said rectangle to provide a desired resonance, said primary folded dipole element with said extensions and said first parasitic folded dipole element being formed of metal on a printed circuit board;

said extensions having a distal end with said extensions increasing in width toward said distal end to provide a wider bandwidth response.

* * * * *